US005341715A

United States Patent [19]

Hucek

[11] Patent Number: 5,341,715

[45] Date of Patent: Aug. 30, 1994

[54] GUITAR PICK WITH STEPPED LEDGE FINGER GRIP

[76] Inventor: Raymond R. Hucek, 2428 Suffolk La., Joliet, Ill. 60433

[21] Appl. No.: 136,604

[22] Filed: Oct. 15, 1993

[51] Int. Cl.[5] ..... G10D 3/16

[52] U.S. Cl. ..... 84/322; D17/20

[58] Field of Search ..... 84/322, 320, 321; D17/20, 99

[56] References Cited

U.S. PATENT DOCUMENTS

D. 330,905 11/1992 Thomas ..... 84/322

1,461,070 7/1923 Rudesyle ..... 84/322

*Primary Examiner*—Michael L. Gellner

*Assistant Examiner*—Cassandra C. Spyrou

*Attorney, Agent, or Firm*—Ernest Kettelson

[57] ABSTRACT

A pick for a guitar or other string instrument comprises a planar tear shaped pick body of relatively rigid thermoplastic or other similar material having a tapered string contact end and an opposite rounded finger grasp end. The finger grasp end has diagonally extending raised ledges or walls projecting outwardly from each oppositely facing surface of the pick body at acute angles to the longitudinal axis of the pick body at the finger grasp end, such ledges or walls having diagonally extending outer edges, and raised surfaces extending laterally from the respective outer edges of the outwardly projecting ledges or walls to terminate at the respective nearest side edges of the pick body, the raised surfaces lying in planes which are spaced apart outwardly from the respective primary and oppositely facing planar surfaces of the pick body. Additional raised ledges or walls and raised surfaces extending laterally therefrom to the respective nearest side edge of the pick body can be provided which project outwardly from respective ones of the first mentioned raised surfaces on diagonal lines which are parallel to respective ones of the first mentioned diagonally extending ledges or walls and spaced apart therefrom in the direction toward the respective nearest side edges of the pick body. The raised ledges or walls and raised surfaces provide an improved finger grasp construction for a string instrument pick.

15 Claims, 7 Drawing Sheets

GUITAR PICK WITH STEPPED LEDGE FINGER GRIP

BACKGROUND OF THE INVENTION

This invention relates to the field of picks for string instruments such as guitars, banjoes, ukuleles and the like. In particular it relates to a planar surface type of pick which the musician holds between his thumb and forefinger, and in improved finger grip structure thereof.

Prior art picks of this kind for string instruments of which the inventor is aware, include those described in the following United States patents and one French patent.

U.S. Pat. No. 4,993,302 discloses a guitar pick having a flexible piece of rubber glued to each oppositely facing surface of the pick, and a coat of non-hardening adhesive on the outwardly facing surface of each of the flexible pieces of rubber to give the guitar player a better grip on the pick held between his thumb and forefinger.

U.S. Pat. No. 4,711,150 discloses a pick for string instruments in which the thumb side has a generally rectangular recess and the forefinger side has a generally rectangular slot having a center line which forms a transverse angle with the length of the thumb gripping recess.

U.S. Pat. No. 4,625,615 discloses a pick for string instruments which has a radially extending raised portion on one surface and a complementary depression on the opposite surface, the player's forefinger to lie within the depression and his thumb to lie perpendicular across the raised portion for a more secure grip.

U.S. Pat. No. 4,347,773 discloses a musician's pick having a string contact or pick portion and an upper grip portion, the grip portion being semi-circular in peripheral configuration, the pick portion extending from the grip portion for a predetermined length and tapering to a point, the grip portion and pick portion being angularly oriented to each other in such a way that the pick portion engages the strings in a generally parallel relationship despite the normal, non-parallel relationship of the strings to the longitudinal axis of the user's forearm.

U.S. Pat. No. 4,150,601 discloses a string instrument pick having a pair of spaced apart raised ledges on each opposite surface to form a channel therebetween for the thumb on one side and the forefinger on the opposite side, the spaced apart ledges which form the channel for the thumb running longitudinally of the pick and those on the opposite side which form the channel for the forefinger running laterally of the pick.

U.S. Pat. No. 3,319,505 discloses a pick for musical instruments having a relatively large hole through the pick at a mid-region thereof for the thumb and forefinger on each opposite side to partially enter and partially contact each other to provide a better non-slip grip, the picks also having a plurality of smaller holes therethrough located radially outwardly from the larger hole to enable the pick to vibrate and impart such vibration to the strings.

U.S. Pat. No. 2,170,179 discloses a pick or plectrum for a string instrument having an enlarged cross-sectional central portion, the cross-section tapering toward the edges, and a depression formed in the enlarged cross-section central portion on each opposite side for the thumb and forefinger, thereby improving their grip on the pick.

U.S. Pat. No. 1,547,560 discloses a pick for string instruments having a flat tapered lower end for contact with the strings and an opposite end which is broad for gripping by the thumb and forefinger, also slightly twisted relative to the tapered lower end so the lower end will be in a position to strike the strings with its flat side.

U.S. Pat. No. 1,184,561 discloses a pick or plectrum for musical instruments and for mandolins in particular and a holder of rubber or other compressive friction enhancing material to receive the finger grip portion of the pick, the holder having a hole through the center or mid-region of each opposite side wall for the flesh of the finger and thumb to seat in as the pick with holder is grasped, thereby increasing the player's grip on the pick.

U.S. Pat. No. 1,117,056 discloses a pick for a musical instrument having holes arrayed in the shape of a diamond and elastic plugs forced through the holes to extend outwardly from each opposite side for the thumb and forefinger to grip thereby giving the player a more secure grasp of the pick.

U.S. Pat. No. 1,009,403 discloses a pick comprising a resilient body portion which tapers to a point at its string contact end and which has a saucer shaped finger grip piece connected to the center of the finger grasp end by an eyelet to give the player a better hold or grip on the pick.

Design Patent No. Des 330,905 discloses a string instrument pick of triangular configuration which has a completely flat or planar surface on one side and a diamond shaped raised portion projecting outwardly from the opposite side extending from a first angle to terminate at the mid-point of the side opposite, one triangular sector bounded by a second angle, its adjacent sides and one side of the diamond shaped raised portion being thicker in cross-section than the remaining triangular sector bounded by the third angle, by its sides adjacent and by an opposite side of the diamond shaped raised portion.

Design Patent No. Des 292,413 discloses an instrument pick of generally triangular design having an ovular raised portion in each opposite corner of the finger grip end of the pick and projecting outwardly from each opposite surface.

French Patent No. 82-15724 (Publication No. 2,533,344) discloses a pick for string instruments in the form of a triangle having sides A B C, having a relatively thick cross-section which tapers to a point at the string contact end at angle C, a first channel or depression across the surface of one side which the inventor says is parallel to side edge A B opposite from the string contact point at angle C, and a second channel or depression across the surface of the opposite side which the inventor says is parallel to the side edge A C being one of the sides adjacent to the string contact point at angle C.

SUMMARY OF THE INVENTION

The pick in accordance with the present invention provides an improved finger grasp construction whereby the musician can have a more secure grip of the pick giving him or her better control for playing the guitar or other string instrument. Also the more secure grip of the pick can be obtained without as much pressure between the thumb and forefinger by virtue of the improved finger grasp construction, thereby enabling the musician to grasp the pick properly for longer periods of time with less fatigue.

The pick in accordance with this invention is also easier to manufacture since it merely requires a stepped up diagonal ledge or surface projecting from each opposite surface of the otherwise planar pick, in one corner region of the finger grasp end of one surface and in the opposite corner region of the finger grasp end of the opposite surface.

The improved finger grasp construction comprises a first raised ledge or wall projecting outwardly from one surface of the pick starting at the mid-point edge of the finger grip end and extending at a diagonal to and on one side of the longitudinal axis of the pick until it intersects a first side edge of the pick about midway between the pointed string contact end of the pick and the mid-point edge of the opposite finger grip end of the pick, and a second raised ledge or wall projecting outwardly from the oppositely facing surface of the pick starting at the mid-point edge of the finger grip end and extending at a diagonal to and on the other side of the longitudinal axis of the pick until it intersects the opposite second side edge of the pick about midway between the pointed string contact end of the pick and the mid-point edge of the opposite finger grip end of the pick.

A first raised surface extends from the upper or outer edge of the first raised ledge or wall to the first side edge of the pick in a plane which is parallel to the rest of the pick surface on the side facing outwardly in one direction and spaced apart outwardly therefrom, and a second raised surface extends from the upper or outer edge of the second raised ledge or wall to the opposite second side edge of the pick in a plane which is parallel to the rest of the pick surface on the side facing outwardly in the opposite direction and spaced apart outwardly therefrom.

In a modification of the improved finger grasp construction in accordance with this invention, a third raised ledge or wall and third raised surface extends parallel to the first raised ledge or wall outwardly from the first raised surface at a location between the first raised ledge or wall and the first side edge of the pick, and a fourth raised ledge or wall and fourth raised surface extends parallel to the second raised ledge or wall outwardly from the second raised surface at a location between the second raised ledge or wall and the second side edge of the pick.

The angle of the raised ledges or walls and raised surfaces which extend laterally therefrom is such that the longitudinal mid-line of a player's thumb will contact and bear against the raised ledge projecting outwardly from one surface of the pick and the rest of his or her thumb toward the side edge of the pick which the raised ledge intersects will contact and bear against the raised surface extending laterally from that raised ledge to that side edge of the pick. The rest of the player's thumb on the opposite side of the ledge will contact and bear against the lower or inward primary surface of the pick, thereby providing both an abutment ledge and a thickened portion of the pick extending from such ledge to the side edge of the pick for the thumb to bear against and grip.

The angle of the raised ledges or walls and raised surfaces which extend laterally therefrom is such that the longitudinal mid-line of a player's forefinger will contact and bear against the raised ledge projecting outwardly from the oppositely facing surface of the pick and the rest of his or her forefinger toward the side edge of the pick which the raised ledge intersects will contact and bear against the raised surface extending laterally from that raised ledge to that side edge of the pick. The rest of the player's forefinger on the opposite side of the ledge will contact and bear against the lower or inward primary surface of the pick, thereby providing both an abutment ledge and thickened portion of the pick extending from such ledge to the side edge of the pick for the forefinger to abut against and grip.

For a musician who holds the pick in his right hand, the raised ledges or walls and raised surfaces extending laterally therefrom are located to the left of the longitudinal axis of the pick extending from its mid-point edge of its finger grasp end to its pointed string contact end on both oppositely facing surfaces when the ledges and raised surfaces projecting from either surface are facing the viewer with the pick held finger grasp end up and pointed string contact end down.

For a musician who holds the pick in his left hand, the raised ledges or walls and raised surfaces extending laterally therefrom are located to the right of the longitudinal axis of the pick when held and viewed in the same way.

The finger grasp construction in accordance with the present invention makes it easier for the musician to grasp the pick farther toward the finger grasp end in one case and closer to the opposite string contact end in the second case to thereby achieve varying musical results. For example, it is better to hold the pick closer to the finger grasp end for playing chords, and closer to the opposite string contact end for playing individual notes of the lead.

DESCRIPTION OF PREFERRED EMBODIMENT

Figure 1:
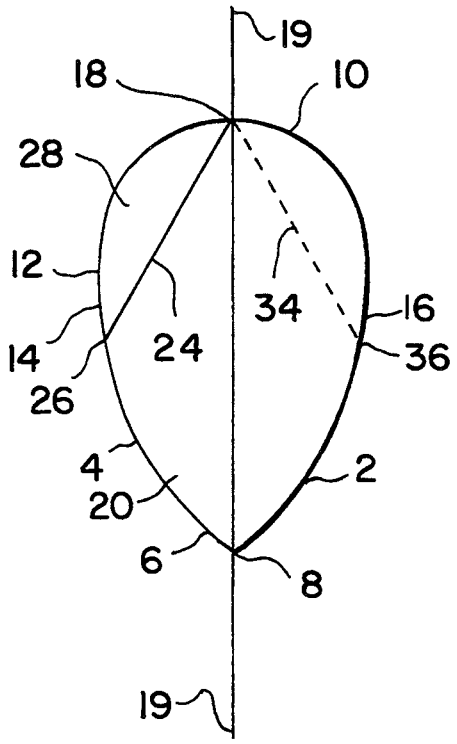
FIG. 1 is a plan view of a pick in accordance with this invention showing the finger grasp wall or ledge and raised surface projecting outward from one primary surface of the pick and showing the finger grasp wall or ledge projecting outward from the opposite side in phantom by broken lines.
Figure 2:
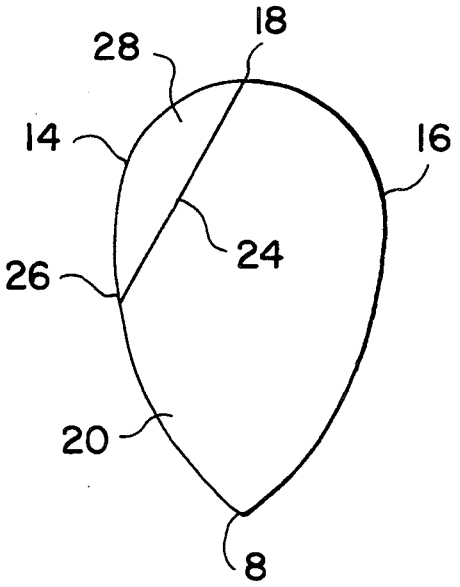
FIG. 2 is a plan view, of one outwardly facing surface of the pick illustrating the finger grasp wall or ledge and raised surface projecting outwardly therefrom.
Figure 3:
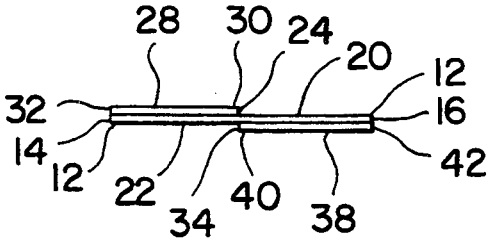
FIG. 3 is an end elevation view of the pick shown in FIG. 2 taken from the tapered lower end.
Figure 4:
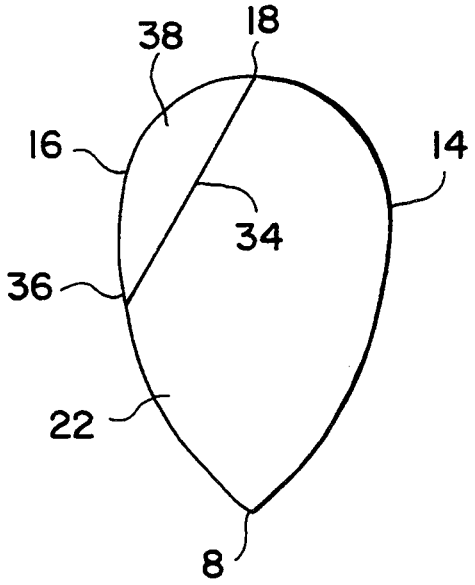
FIG. 4 is a plan view of the oppositely facing surface of the pick shown in FIG. 2 illustrating the finger grasp wall or ledge and raised surface projecting outwardly therefrom.
Figure 5:
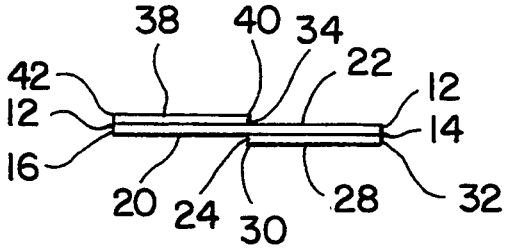
FIG. 5 is an end elevation view of the pick shown in FIG. 4 taken from the tapered lower end.
Figure 6:
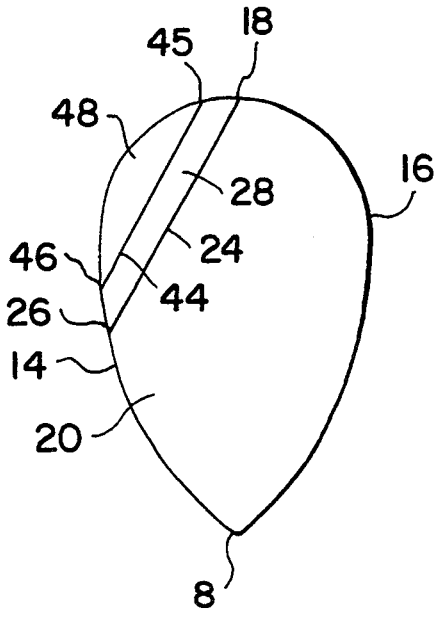
FIG. 6 is a plan view of one outwardly facing surface of a modified pick in accordance with this invention, illustrating a first finger grasp wall and raised surface and a stepped up second finger grasp wall and raised surface.
Figure 7:
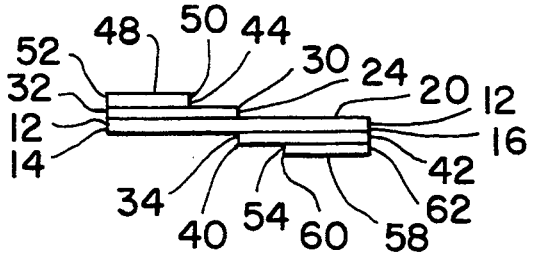
FIG. 7 is an end elevation view of the modified pick shown in FIG. 6 taken from the tapered lower end.
Figure 8:
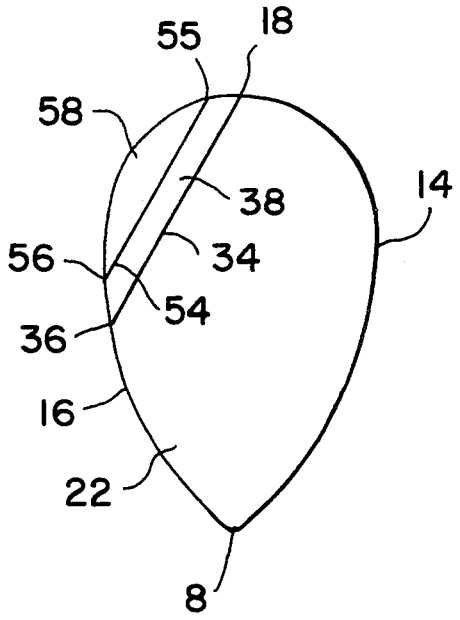
FIG. 8 is a plan view of the oppositely facing surface of the modified pick shown in FIG. 6, illustrating the first and second finger grasp walls and raised surfaces on the opposite side of the pick.
Figure 9:
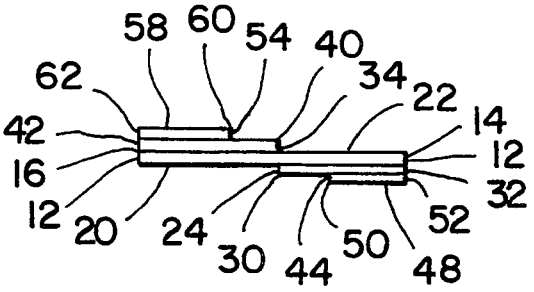
FIG. 9 is an end elevation view of the modified pick shown in FIG. 8 taken from the tapered lower end.
Figure 10:
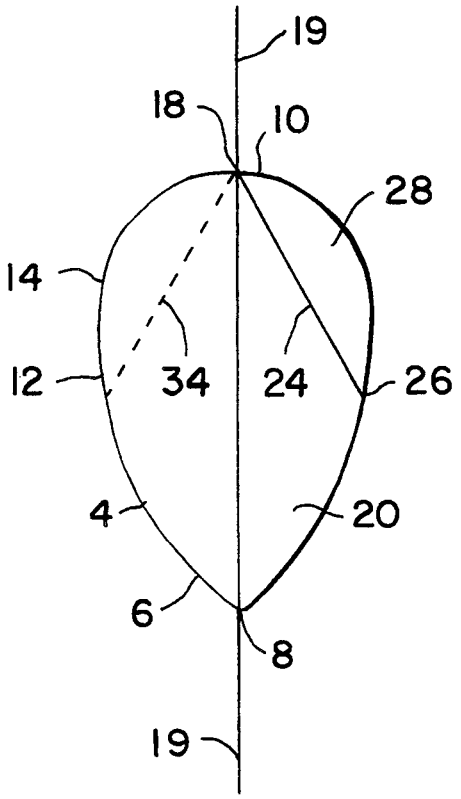
FIG. 10 is a plan view of a pick in accordance with this invention having a finger grasp wall or ledge and raised surface located thereon for use by a left hand person to grasp the pick for playing between the thumb and forefinger of his or her left hand, the finger grasp wall or ledge on the opposite side of the pick shown in phantom by broken lines.
Figure 11:
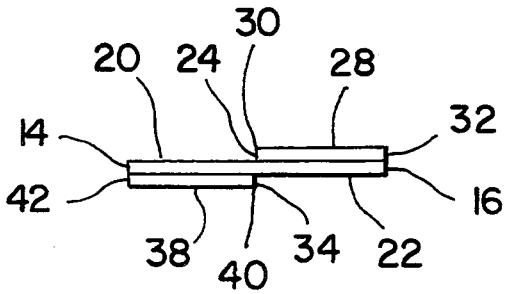
FIG. 11 is an end elevation view of the pick shown in FIG. 10 taken from the tapered lower end.
Figure 12:
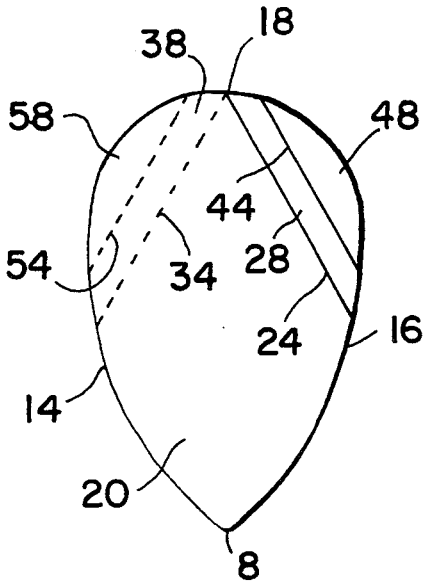
FIG. 12 is a plan view of a pick having first and second finger grasp ledges and raised surfaces positioned for use by a left hander, the finger grasp ledges on the opposite side being shown in phantom by broken lines.
Figure 13:
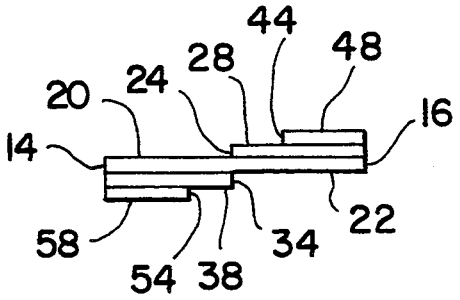
FIG. 13 is an end elevation view of the pick shown in FIG. 12 taken from the tapered lower end.

A guitar pick 2 in accordance with this invention comprises a small tear shaped body 4 to be held between the thumb and forefinger of a guitar player's hand, having a thin forwardly extending contact section 6 which extends forwardly of the player's thumb and forefinger for contact with the strings of a guitar and which tapers to a point 8 at its outermost end, and a rearwardly extending finger grasp section 10.

The tear shaped body 4 has a peripheral edge 12 which diverges from the point 8 at the outermost end as each opposite side 14 and 16 of the peripheral edge 12 extends rearwardly in an arc of progressively decreasing radius until the opposite sides 14 and 16 meet at the rearmost end point 18.

The forward point 8 at the outermost end and the rearmost end point 18 at which the opposite sides 14 and 16 of the peripheral edge 12 meet each lie on the longitudinal axis 19 at opposite ends of the tear shaped body 4 of the pick 2.

The tear shaped body 4 includes a first outwardly facing surface 20 facing in one direction and a second outwardly facing surface 22 facing in the opposite direction.

A first diagonal finger abutment ledge or wall 24 projects outwardly a short distance from the first outwardly facing surface 20 along a diagonal line which extends from the rearmost end point 18 at which the opposite sides 14 and 16 of the peripheral edge 12 meet, forwardly therefrom at a diagonal which terminates at side 14 of the peripheral edge 12 at intersecting point 26 which is substantially even with the midpoint of the longitudinal axis between the rearmost end point 18 and the forward point 8 of the tear shaped body 4 of the pick 2.

A first raised surface 28 extends laterally from the upper edge 30 of the first diagonal finger abutment wall 24 in the direction toward side 14 of the peripheral edge 12 to terminate in a peripheral edge 32 that co-extends with peripheral edge 12 in said arc of progressively decreasing radius from the intersecting point 26 of the first diagonal finger abutment wall 24 to the rearmost end point 18.

A second diagonal finger abutment ledge or wall 34 projects outwardly a short distance from the second outwardly facing surface 22 along a diagonal line which extends from the rearmost end point 18 at which the opposite sides 14 and 16 of the peripheral edge 12 meet, forwardly therefrom at a diagonal which terminates at side 16 of the peripheral edge 12 at intersecting point 36 which is substantially even with the midpoint of the longitudinal axis between the rearmost end point 18 and the forward point 8 of the tear shaped body of the pick 2.

A second raised surface 38 extends laterally from the upper edge 40 of the second diagonal finger abutment wall 34 in the direction toward side 16 of the peripheral edge 12 to terminate in a peripheral edge 42 that co-extends with the peripheral edge 12 in said arc of progressively decreasing radius from the intersecting point 36 of the second diagonal finger abutment wall 34 to the rearmost end point 18.

The first diagonal finger abutment wall 24 extends preferably on a diagonal line which forms an angle of between thirty degrees and thirty-five degrees with and to one side of the longitudinal axis of the tear shaped body 4 at the rearmost end point 18.

The second diagonal finger abutment wall 34 also extends preferably on a diagonal line which forms an angle of between thirty degrees and thirty-five degrees with and to the opposite side of the longitudinal axis of the tear shaped body 4 at the rearmost end point 18.

In a modification of the present invention, a third diagonal finger abutment ledge or wall 44 projects outwardly a short distance from the first raised surface 28 spaced apart rearwardly from the first diagonal finger abutment wall 24 in the direction toward side 14 of the peripheral edge 12. The third diagonal finger abutment wall 44 extends parallel to the first diagonal finger abutment wall 24, one end of which intersects side 14 of peripheral edge 12 at intersection point 45 and its opposite end at intersection point 46.

A third raised surface 48 extends laterally from the upper edge 50 of the third diagonal finger abutment wall 44 in the direction toward side 14 of peripheral edge 12 to terminate in a peripheral edge 52 that co-extends with peripheral edge 12 and peripheral edge 32 in said arc of progressively decreasing radius from the intersecting point 45 to the intersecting point 46.

A fourth diagonal finger abutment ledge or wall 54 projects outwardly a short distance from the second raised surface 38 spaced apart rearwardly from the second diagonal finger abutment wall 34 in the direction toward side 16 of the peripheral edge 12. The fourth diagonal finger abutment wall 54 extends parallel to the second diagonal finger abutment wall 24, one end of which intersects side 16 of peripheral edge 12 at intersection point 55 and its opposite end at intersection point 56.

A fourth raised surface 58 extends laterally from the upper edge 60 of the fourth diagonal finger abutment wall 54 in the direction toward side 16 of peripheral edge 12 to terminate in a peripheral edge 62 that co-extends with peripheral edge 12 and peripheral edge 42 in said arc of progressively decreasing radius from the intersecting point 55 to the intersecting point 56.

The raised ledges extend at an acute angle to the longitudinal axis 19 of the pick body 4 on one side thereof for those who use the pick with their right hand and on the opposite side of the longitudinal axis 19 for those who use the pick with their left hand.

When the pick body is viewed with the finger grasp section 10 above, or superior, and the contact section 6 below, or inferior, the raised ledges 24, 34, 44 and 54 are to left of the longitudinal axis 19 when facing the viewer for a right hand user of the pick as seen FIG. 1 though 9, to the right of the longitudinal axis 19 for a left hand user of the pick as seen FIGS. 10 through 13.

I claim:

1. A pick for a string instrument, comprising a pick body having a tapered first end and an oppositely located rounded second end, a longitudinal axis extending from said first end to said second end, said tapered first end having an outermost point, said rounded second end having a mid-point, said outermost point of said first end being axially aligned with said mid-point of said second end on the longitudinal axis of said pick body, a first pick surface of said pick body facing outwardly in one direction, a second pick surface of said pick body facing outwardly in an opposite direction, a first side and a second opposite side, a first side edge of said pick body extending from said outermost point of said first end to said mid-point of said second end along said first side of said pick body, a second side edge of said pick body extending from said outermost point of said first end of said mid-point of said second end along said second opposite side of said pick body, first finger abutment means projecting outward from said first pick surface on a line extending from substantially said mid-point of said second end to a first intersecting point located on said first side edge between said outermost point of said first end and said mid-point of said second end, and second finger abutment means projecting outward from said second pick surface on a line extending from substantially said mid-point of said second end to a second intersecting point located on said second side edge between said outermost point of said first end and said mid-point of said second end.

2. A pick for a string instrument as set forth in claim 1, wherein said first finger abutment means comprises a continuous abutment ledge extending in a substantially straight line from substantially said mid-point of said second end to said first intersecting point on said first side edge, and said second finger abutment means comprises a continuous abutment ledge extending in a substantially straight line from substantially said mid-point of said second end to said second intersecting point on said second side edge.

3. A pick for a string instrument as set forth in claim 1, wherein said first finger abutment means comprises a continuous first abutment wall extending in a substantially straight line from substantially said mid-point of said second end to said first intersecting point on said first side edge, and said second finger abutment means comprises a continuous second abutment wall extending in a substantially straight line from substantially said mid-point of said second end to said second intersecting point on said second side edge, said first and second abutment walls each having an outer edge.

4. A pick for a string instrument as set forth in claim 3, including a first raised surface extending laterally from said outer edge of said first abutment wall to said first side edge of said pick body between said mid-point of said second end and said first intersecting point on said first side edge, said first raised surface being spaced apart outwardly from said first pick surface of said pick body, said outer edge of said first abutment wall being also spaced apart outwardly from said first pick surface of said pick body, and a second raised surface extending laterally from said outer edge of said second abutment wall to said second side edge of said pick body between said mid-point of said second end and said second intersecting point on said second side edge, said second raised surface being spaced apart outwardly from said second pick surface of said pick body, said outer edge of said second abutment wall being also spaced apart outwardly from said second pick surface of said pick body.

5. A pick for a string instrument as set forth in claim 4, including a first abutment ledge projecting outwardly from said first raised surface and extending substantially parallel to said first abutment wall at a location between said outer edge of said first abutment wall and said first side edge of said pick body, said first abutment ledge having a first ledge end terminating at said first side edge at a third intersecting point closer to said mid-point of said second end of said pick body than to said first intersecting point on said first side edge, and a second ledge end terminating at said first side edge at a fourth intersecting point closer to said first intersecting point on said first side edge than to said mid-point of said second end of said pick body.

6. A pick for a string instrument as set forth in claim 5, including a second abutment ledge projecting outwardly from said second raised surface and extending substantially parallel to said second abutment wall at a location between said outer edge of said second abutment wall and said second side edge of said pick body, said second abutment ledge having a first ledge end terminating at said second side edge at a fifth intersecting point closer to said mid-point of said second end of said pick body than to said second intersecting point on said second side edge, and a second ledge end terminating at said second side edge at a sixth intersecting point closer to said second intersecting point on said second side edge than to said mid-point of said second end of said pick body.

7. A pick for a string instrument as set forth in claim 4, including a third abutment wall projecting outwardly from said first raised surface having an outer edge, said third abutment wall extending substantially parallel to said first abutment wall at a location between said outer edge of said first abutment wall and said first side edge of said pick body between said mid-point of said second end and said first intersecting point on said first side edge, and a fourth abutment wall projecting outwardly from said second raised surface having an outer edge, said fourth abutment wall extending substantially parallel to said second abutment wall at a location between said outer edge of said second abutment wall and said second side edge of said pick body between said mid-point of said second end and said second intersecting point on said second side edge.

8. A pick for a string instrument as set forth in claim 7, including a third raised surface extending laterally from said outer edge of said third abutment wall to said first side edge of said pick body, said third raised surface being spaced apart outwardly from said first raised surface and offset therefrom in the direction toward said first side edge, and a fourth raised surface extending laterally from said outer edge of said fourth abutment wall to said second side edge of said pick body, said fourth raised surface being spaced apart outwardly from said second raised surface and offset therefrom in the direction toward said second side edge.

9. A pick for a string instrument as set forth in claim 1, wherein said line on which said first finger abutment means extends forms an acute angle with said longitudinal axis of said pick body which is no smaller than thirty degrees and no greater than thirty-five degrees.

10. A pick for a string instrument as set forth in claim 9, wherein said line on which said second finger adjustment means extends forms an acute angle with said longitudinal axis of said pick body which is no smaller than thirty degrees and no greater than thirty-five degrees.

11. A pick for a string instrument as set forth in claim 1, wherein said line on which said first finger abutment means extends forms a first acute angle with said longitudinal axis of said pick body on said first side thereof, said line on which said second finger abutment means extends forms a second acute angle with said longitudinal axis of said pick body on said second side threof, said first and second acute angles being of substantially the same degree of inclination relative to said longitudinal axis of said pick body.

12. A pick for a string instrument as set forth in claim 1, wherein said first intersecting point located on said first side edge of said pick body is substantially even with the mid-point of said longitudinal axis of said pick body between said outermost point of said first end and said mid-point of said second end.

13. A pick for a string instrument as set forth in claim 12, wherein said second intersecting point located on said second side edge of said pick body is substantially even with the mid-point of said longitudinal axis of said pick body between said outermost point of said first end and said mid-point of said second end.

14. A pick for a string instrument as set forth in claim 1, wherein said line on which said first finger abutment means extends on said first pick surface and said line on which said second finger abutment means extends on said second pick surface form an acute angle at said mid-point of said second end of said pick body which is no less than sixty degrees.

15. A pick for a string instrument as set forth in claim 1, wherein said line on which said first finger abutment means extends on said first pick surface and said line on which said second finger abutment means extends on said second pick surface form an acute angle at said mid-point of said second end of said pick body which is no greater than seventy degrees.

* * * * *